US007905455B1

(12) United States Patent
Aakre

(10) Patent No.: US 7,905,455 B1
(45) Date of Patent: Mar. 15, 2011

(54) FIRE HOSE SAFETY ANCHOR AND SECUREMENT SYSTEM

(75) Inventor: Ellis L. Aakre, Hawley, MN (US)

(73) Assignee: Rice Hydro, Inc., Carson City, NV (US)

( * ) Notice: Subject to any disclaimer, the term of this patent is extended or adjusted under 35 U.S.C. 154(b) by 822 days.

(21) Appl. No.: 11/213,541

(22) Filed: Aug. 25, 2005

(51) Int. Cl.
*B05B 15/00* (2006.01)

(52) U.S. Cl. ..... 248/89; 248/80; 248/68.1

(58) Field of Classification Search ..... 248/89, 248/90, 75, 80, 81, 65, 73, 68.1; 211/60.1, 211/70

See application file for complete search history.

(56) References Cited

U.S. PATENT DOCUMENTS

| | | | | | |
|---|---|---|---|---|---|
| 1,809,550 | A | | 6/1931 | Farrar | |
| 2,045,336 | A | | 6/1936 | Skoglund | 248/80 |
| 2,439,642 | A | | 4/1948 | White | 248/84 |
| 2,464,366 | A | | 3/1949 | Bakke | 248/80 |
| 3,119,587 | A | | 1/1964 | Anderson | 248/75 |
| 3,645,484 | A | | 2/1972 | Itner | 248/80 |
| 3,819,137 | A | * | 6/1974 | Smith | 248/49 |
| 4,081,170 | A | | 3/1978 | Doss, Jr. | 251/5 |
| 4,187,913 | A | | 2/1980 | Wilcox | 169/51 |
| 4,234,012 | A | * | 11/1980 | Schupback | 137/899.1 |
| 4,268,004 | A | | 5/1981 | Gatin | 251/5 |
| 4,323,219 | A | | 4/1982 | Carlin | 251/5 |
| 4,391,471 | A | * | 7/1983 | Hauschopp et al. | 299/43 |
| 4,467,997 | A | | 8/1984 | Ziaylek, Jr. | 251/7 |
| 4,470,177 | A | | 9/1984 | Ganung et al. | 24/270 |
| 4,582,292 | A | | 4/1986 | Glotzback et al. | 251/9 |
| 4,712,755 | A | | 12/1987 | Robbins et al. | 248/49 |
| 4,715,570 | A | * | 12/1987 | Mashuda | 248/49 |
| 4,978,100 | A | | 12/1990 | Peurifoy | 251/8 |
| 5,000,405 | A | | 3/1991 | Rybak et al. | 248/80 |
| 5,042,757 | A | | 8/1991 | Jenkins et al. | 248/75 |
| 5,273,253 | A | | 12/1993 | Rogers | 251/9 |
| 5,311,909 | A | | 5/1994 | Adcock | 137/899 |
| 5,367,127 | A | * | 11/1994 | Dormon | 174/146 |
| 5,642,612 | A | * | 7/1997 | Hughes | 59/78.1 |
| 5,829,243 | A | * | 11/1998 | Hughes | 59/78.1 |
| 6,095,462 | A | | 8/2000 | Morgan | 248/82 |
| 6,332,595 | B1 | | 12/2001 | Klucznik | 248/87 |
| 6,625,849 | B1 | * | 9/2003 | Womack et al. | 24/115 M |
| 6,752,360 | B2 | * | 6/2004 | Bennett | 248/68.1 |
| 6,945,735 | B1 | * | 9/2005 | Doverspike | 405/184.4 |
| 2005/0029410 | A1 | | 2/2005 | Walker | 248/80 |

* cited by examiner

*Primary Examiner* — Terrell Mckinnon
*Assistant Examiner* — Steven M Marsh
(74) *Attorney, Agent, or Firm* — Ian F. Burns & Associates, P.C.

(57) ABSTRACT

A fire hose safety anchor and securement system for efficiently and safely retaining multiple fire hoses during pressure testing. The fire hose safety anchor and securement system includes a base member comprised of a base plate and a pair of attached mounting plates interconnected by a pair of retaining brackets and retaining pins. The base member is preferably secured to a floor surface by extending fasteners through a plurality of first anchor apertures. Hoses laid upon the base member are held in place by the retaining brackets. The retaining brackets are connected to the base member mounting plates by extending retaining pins through a mounting aperture in the mounting plates and a first aperture and a second aperture in the retaining brackets.

10 Claims, 7 Drawing Sheets

FIRE HOSE SAFETY ANCHOR AND SECUREMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hose retaining devices and more specifically it relates to a fire hose safety anchor and securement system for efficiently and safely retaining multiple fire hoses during pressure testing.

2. Description of the Related Art

Any discussion of the prior art throughout the specification should in no way be considered as an admission that such prior art is widely known or forms part of common general knowledge in the field.

Hose retaining devices have been in use for years. Typically, hose holding devices consist of an apparatus having apertures or a mechanism for receiving a single hose, a garden hose for example. The device can loosely accept a hose and secure it for the water pressure required for its particular purpose. Unfortunately, hose holders currently used today do not retain multiple hoses with large diameters (e.g. fire hoses) nor do they safely secure them at the water pressures required for fire hoses.

While these devices may be suitable for the particular purpose to which they address, they are not as suitable for efficiently and safely retaining multiple fire hoses during pressure testing. Current hose holding devices do not safely secure multiple large diameter hoses that utilize high water pressure.

In these respects, the fire hose safety anchor and securement system according to the present invention substantially departs from the conventional concepts and designs of the prior art, and in so doing provides an apparatus primarily developed for the purpose of efficiently and safely retaining multiple fire hoses during pressure testing.

BRIEF SUMMARY OF THE INVENTION

In view of the foregoing disadvantages inherent in the known types of hose retaining devices now present in the prior art, the present invention provides a new fire hose safety anchor and securement system construction wherein the same can be utilized for efficiently and safely retaining multiple fire hoses during pressure testing.

The general purpose of the present invention, which will be described subsequently in greater detail, is to provide a new fire hose safety anchor and securement system that has many of the advantages of the hose retaining devices mentioned heretofore and many novel features that result in a new fire hose safety anchor and securement system which is not anticipated, rendered obvious, suggested, or even implied by any of the prior art hose retaining devices, either alone or in any combination thereof.

To attain this, the present invention generally comprises a base member comprised of a base plate and a pair of attached mounting plates interconnected by a pair of retaining brackets and retaining pins. The base member is preferably secured to a floor surface by extending fasteners through a plurality of first anchor apertures. Hoses laid upon the base member are held in place by the retaining brackets. The retaining brackets are connected to the base member mounting plates by extending retaining pins through a mounting aperture in the mounting plates and a first aperture and a second aperture in the retaining brackets.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a fire hose safety anchor and securement system that will overcome the shortcomings of the prior art devices.

A second object is to provide a fire hose safety anchor and securement system for efficiently and safely retaining multiple fire hoses during pressure testing.

Another object is to provide a fire hose safety anchor and securement system that adjusts for varying hose diameters.

An additional object is to provide a fire hose safety anchor and securement system that is easily assembled for use.

A further object is to provide a fire hose safety anchor and securement system that meets the National Fire Protection Association code for fire hose testing equipment.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
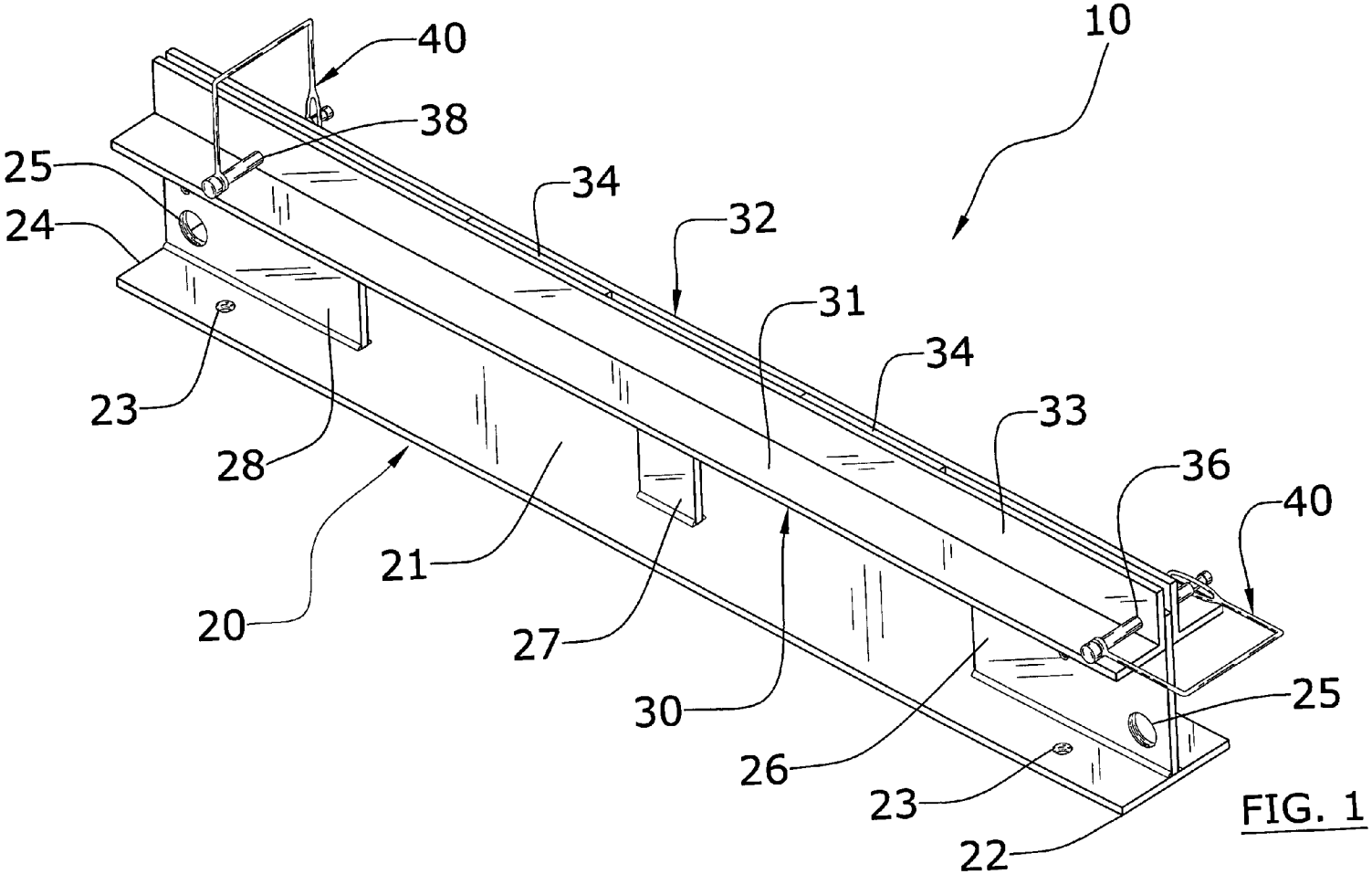
FIG. 1 is an upper perspective view of the present invention.

Turning now descriptively to the drawings, in which similar reference characters denote similar elements throughout the several views, FIGS. 1 through 7 illustrate a fire hose safety anchor and securement system 10, which is comprised of a base member 20 including a base plate 21 and a pair of attached mounting plates 26, 28 interconnected by a pair of retaining brackets 30, 32 and retaining pins 40. The base member 20 is preferably secured to a floor surface by extending fasteners through a plurality of first anchor apertures 23. Hoses 12 laid upon the base member 20 are held in place by the retaining brackets 30, 32. The retaining brackets 30, 32 are connected to the base member 20 mounting plates 26, 28 by extending retaining pins 40 through a mounting aperture 29 in the mounting plates 26, 28 and a first aperture 36 and a second aperture 38 in the retaining brackets 30, 32.

B. Base Member

The base member 20 is comprised of a base plate 21, a first mounting plate 26, a second mounting plate 28 and a center plate 27. The base member 20 components 21, 26, 27, 28 are preferably made of a rigid materials that will not significantly distort when welded to or while retaining hoses 12 in the normal usage of the fire hose safety anchor and securement system 10. The base member 20 components 21, 26, 27, 28 are preferably made of a material which will withstand long periods of exposure to moisture such that it will not rust. The base member 20 components 21, 26, 27, 28 may additionally be coated with a finishing material which must adhere to the base member 20 components 21, 26, 27, 28 and withstand long exposure to moisture.

The base plate 21 is a substantially flat plate extending from a first end 22 to a second end 24 preferably constructed of a metal material (e.g. steel). As shown in FIGS. 1 through 7, towards the ends 22, 24 and outer perimeter of the base plate 21 is a plurality of first anchor apertures 23. The first anchor apertures 23 are used for extending fasteners through to retain the base member 20 to the floor or ground during usage of the fire hose safety anchor and securement system 10. The fasteners can permanently fix or allow for assembly and disassembly of the base member 20 and fire hose safety anchor and securement system 10.

The first mounting plate 26 and second mounting plate 28 are substantially flat plates preferably constructed of a metal material (e.g. steel). The mounting plates 26, 28 are attached to the base plate 21 preferably by welding, but it can be appreciated that other methods of attachment are possible. As shown in FIGS. 1 through 7, the first mounting plate 26 is positioned perpendicular to the base plate 21, centered on a centerline extending from the first end 22 to the second end 24 of the base plate 21 and located at the first end 22 of the base plate 21. The second mounting plate 28 is positioned perpendicular to the base plate 21, centered on a centerline extending from the first end 22 to the second end 24 of the base plate 21 and located at the second end 24 of the base plate 21.

Figure 3:
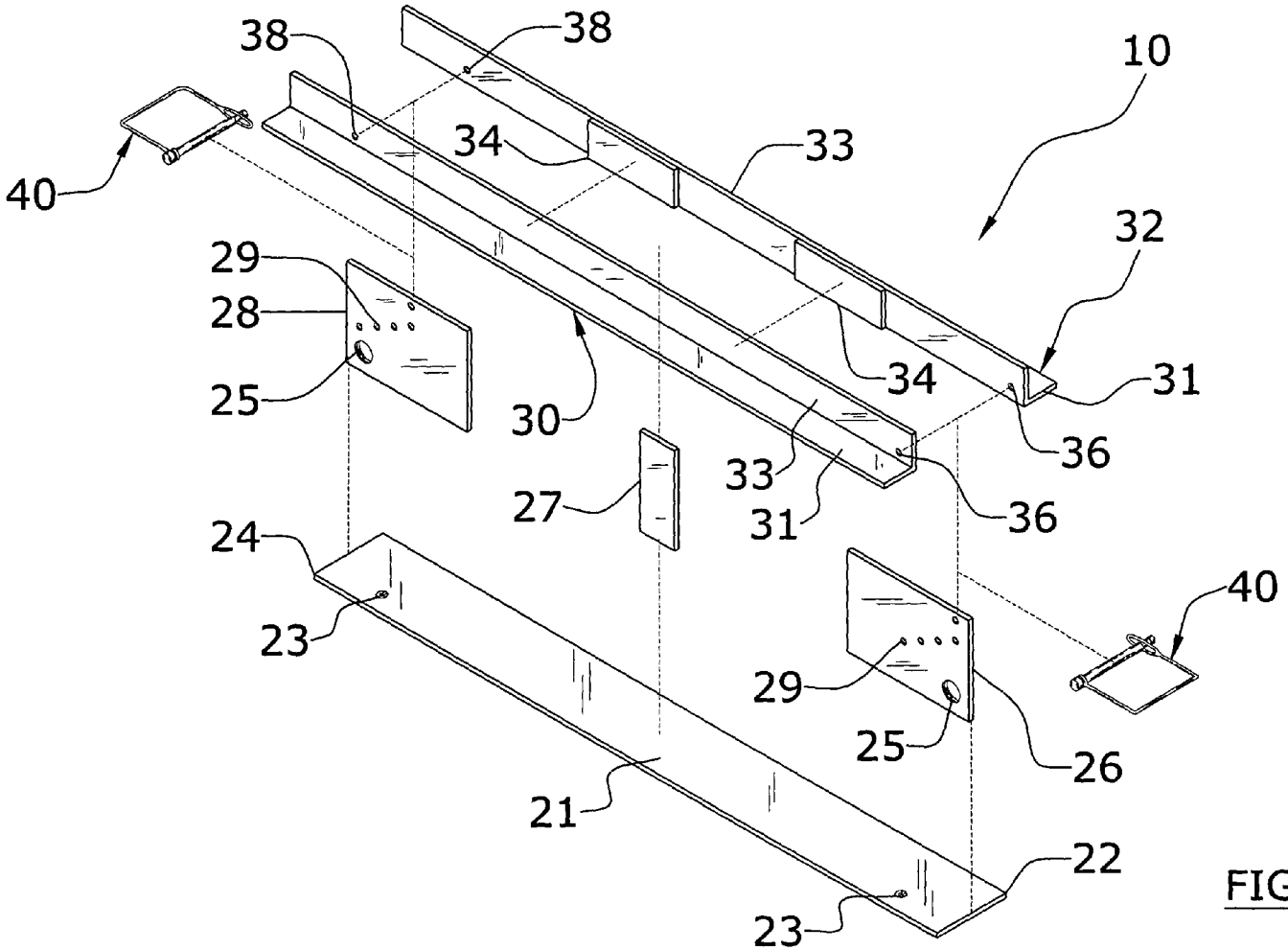
FIG. 3 is an exploded upper perspective view of the present invention.
Figure 4:
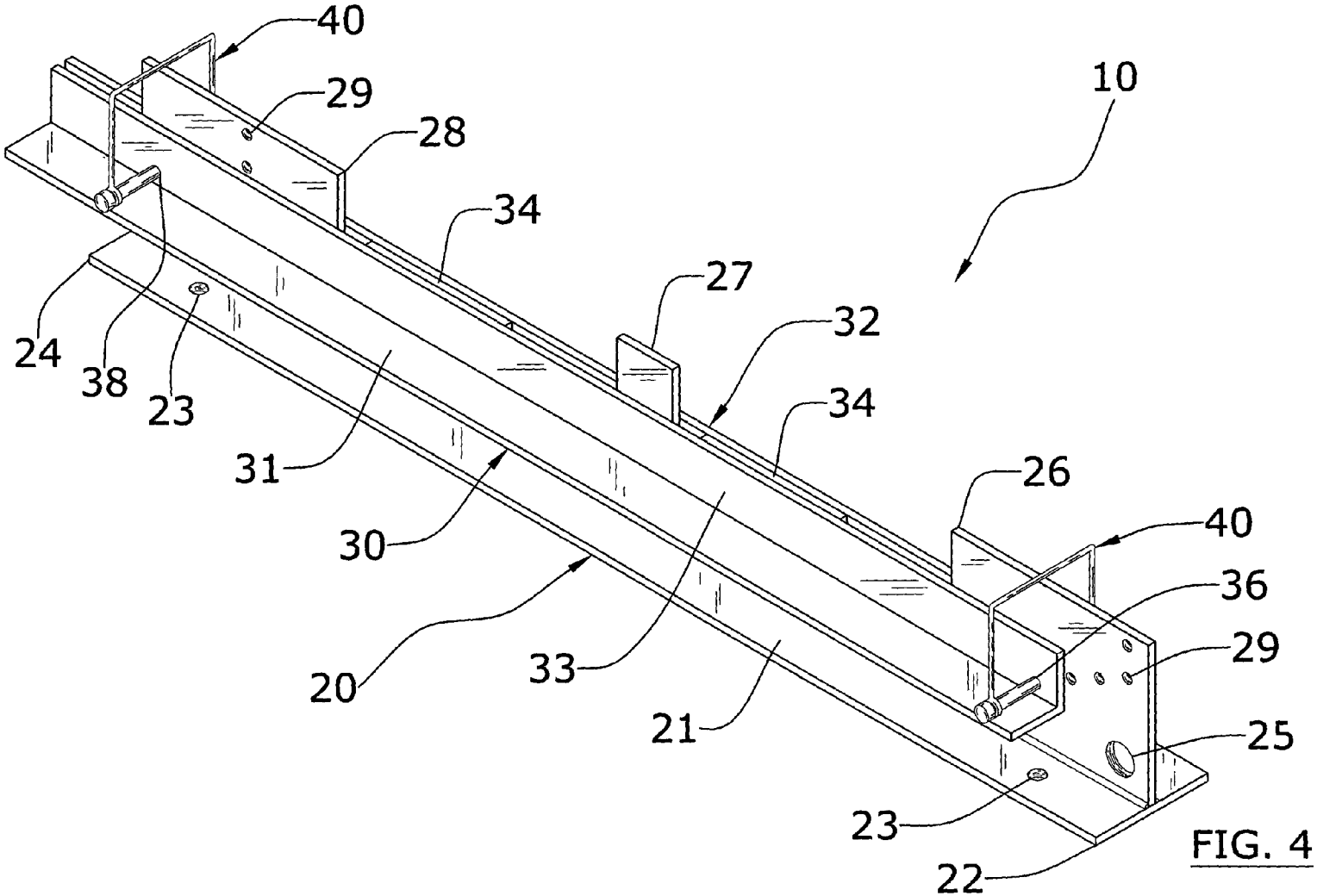
FIG. 4 is an upper perspective view of the present invention showing an alternative configuration for smaller hose diameters.

Located in both the first mounting plate 26 and second mounting plate 28 is a pattern of mounting apertures 29. As best shown in FIG. 3, the pattern of mounting apertures 29 in each mounting plate 26, 28 are substantially identical and aligned to allow for the attachment of the first retaining bracket 30 and second retaining bracket 32. The mounting apertures 29 are sized to accept a retaining pin 40. The pattern of mounting apertures 29 in the mounting plates 26, 28 is designed to allow for the retaining brackets 30, 32 to be positioned parallel and at varying heights in relation to the base plate 21 to compensate for varying hose 12 diameters.

Also located in both the first mounting plate 26 and second mounting plate 28 is a second anchor aperture 25. As shown in FIGS. 1 through 7, the second anchor aperture 25 is sized larger than the first anchor aperture 23 located in the base plate 21 to allow for a rope or the like to extend through. This allows the base member 20 and fire hose safety anchor and securement system 10 to be fastened to other items such as a truck bed or pole.

The center plate 27 is a substantially flat plate preferably constructed of a metal material (e.g. steel). The center plate 27 is attached to the base plate 21 preferably by welding, but it can be appreciated that other methods of attachment are possible. As shown in FIGS. 1 through 7, the center plate 27 is positioned perpendicular to the base plate 21, aligned with the mounting plates 26, 28 and located a equal distance from each mounting plate 26, 28.

C. Retaining Pin

The retaining pins 40 are preferably made of a rigid material that will not significantly distort while retaining the first retaining bracket 30 and second retaining bracket 32 in the normal usage of the fire hose safety anchor and securement system 10. The retaining pins 40 are preferably made of a material which will withstand long periods of exposure to moisture such that it will not rust. The retaining pins 40 are sized to securely fit within and extend through the apertures 36, 38 located in the retaining brackets 30, 32 and mounting apertures 29 in the mounting plates 26, 28.

D. Retaining Brackets

The first retaining bracket 30 and second retaining bracket 32 are preferably made of a rigid material that will not significantly distort when welded to or while retaining hoses 12 in the normal usage of the fire hose safety anchor and securement system 10. The retaining brackets 30, 32 are preferably made of a material which will withstand long periods of exposure to moisture such that it will not rust. The retaining brackets 30, 32 may additionally be coated with a finishing material which must adhere to the retaining brackets 30, 32 and withstand long exposure to moisture. The retaining brackets 30, 32 are preferably constructed of structural angle material having a base 31 and a wall 33.

As shown in FIGS. 1 through 7, the retaining brackets 30, 32 extend substantially straight and are similar in length to the base plate 21. Located in the wall 33 at one end of the retaining brackets 30, 32 is a first aperture 36 and located towards the other end of the retaining brackets 30, 32 is a second aperture 38. The apertures 36, 38 are positioned and sized to allow a retaining pin 40 or the like to extend through and mount the retaining brackets 30, 32 to the mounting brackets 26, 28 on the base member 20.

Located on one of the retaining brackets 30, 32, preferably the second retaining bracket 32, are a pair of spacer plates 34. The spacer plates 34 are substantially flat plates preferably constructed of a metal material (e.g. steel) substantially the same thickness of the mounting plates 26, 28. The spacer plates 34 are preferably welded to the retaining brackets 30, 32, but other methods of attachment (e.g. fasteners) can be appreciated. As shown in FIGS. 1 through 7, the spacer plates 34 are positioned substantially adjacent to the wall 33 on either retaining bracket 30, 32, spaced an equal distance from the center of the desired retaining bracket 30, 32.

E. Operation of the Invention

In use, the fire hose safety anchor and securement system 10 is preferably utilized to secure fire hoses 12 during water pressure testing of the hoses 12. However, it can be appreciated that the fire hose safety anchor and securement system 10 could be used to water pressure test hoses 12 used for other applications.

Initially to use the fire hose safety anchor and securement system 10, a location is found to place and secure the base member 20 such that the water sprayed from the hoses 12 will not damage any objects or harm any users. The base member 20 is preferably secured to a floor surface by extending fasteners through the first anchor apertures 23 located in the base plate 21.

Figure 5:
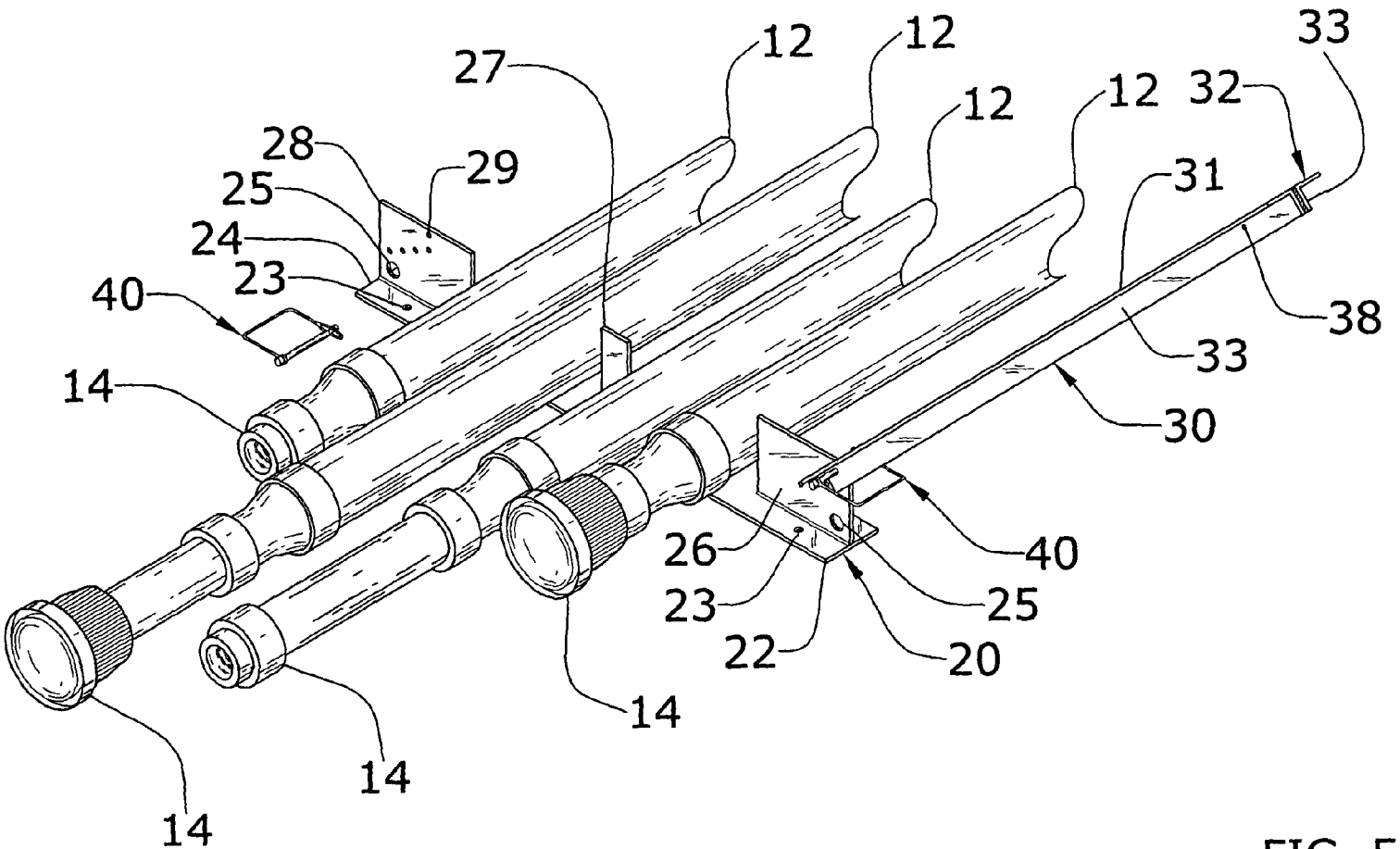
FIG. 5 is an upper perspective view of the present invention with retaining brackets rotated and hoses in place.
Figure 6:
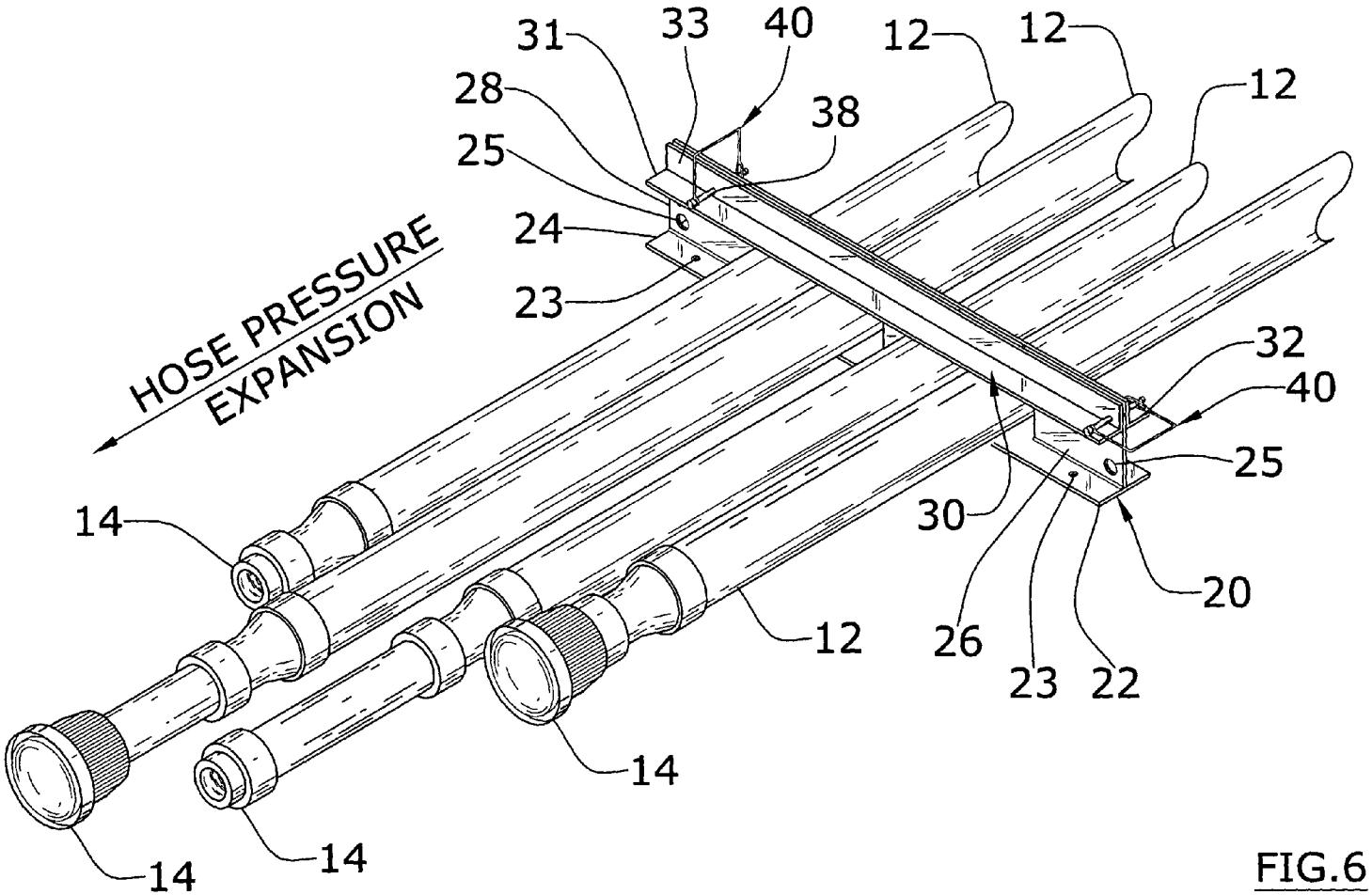
FIG. 6 is an upper perspective view of the present invention with hoses retained and showing hose expansion from water pressure.

As best shown in FIG. 5, the hoses 12 are laid upon the base plate 21 between the openings of the center plate 27 and mounting plates 26, 28. The hoses 12 are positioned with the coupling 14 ends forward of the base plate 21 edge. As shown in FIG. 6, the first retaining bracket 30 and second retaining bracket 32 are then placed upon the hoses 12 to determine which mounting apertures 29 in the mounting plates 26, 28 should be used to match the hose 12 diameter.

Figure 2:
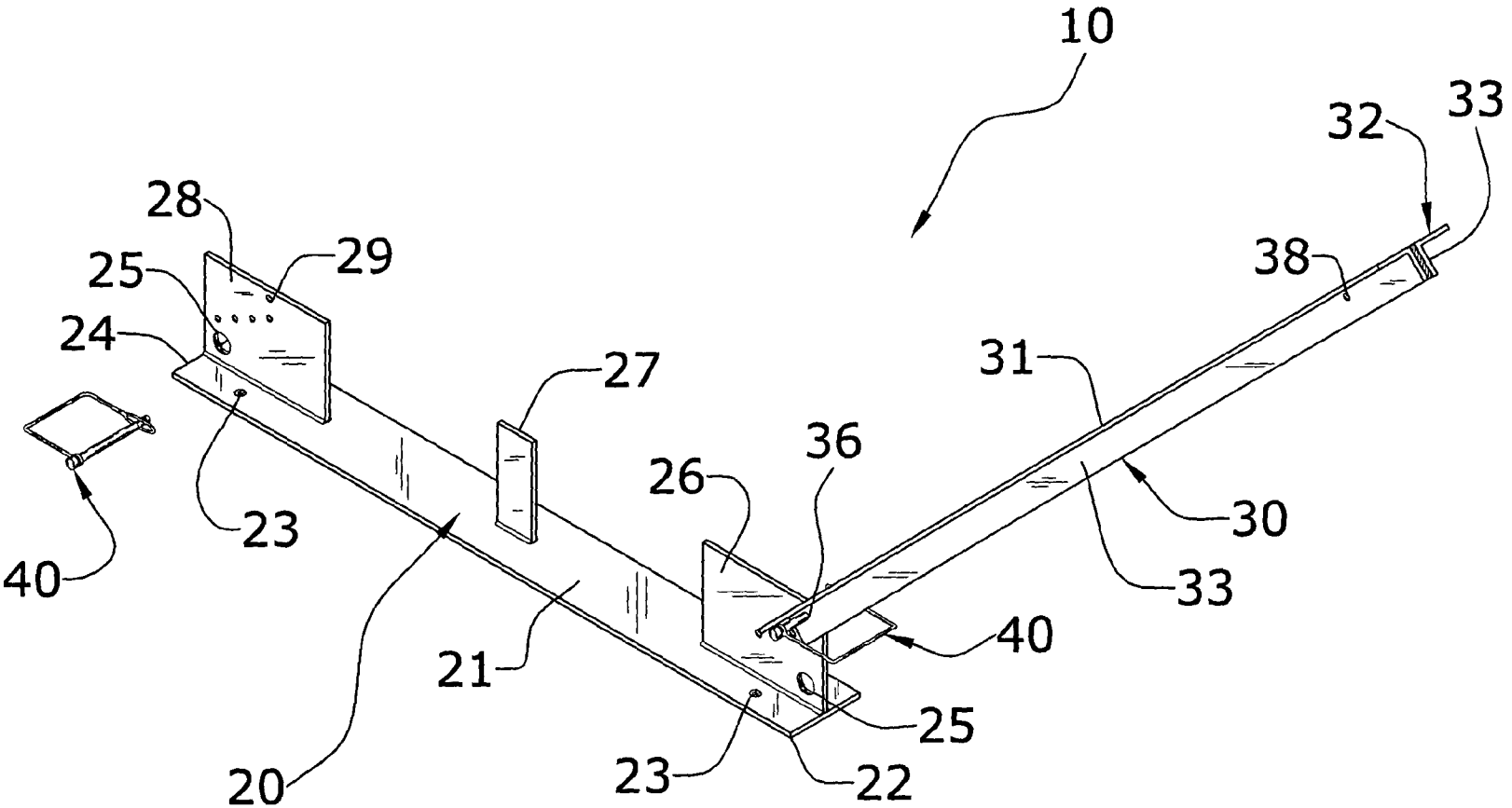
FIG. 2 is an upper perspective view of the present invention with retaining brackets rotated.
Figure 7:
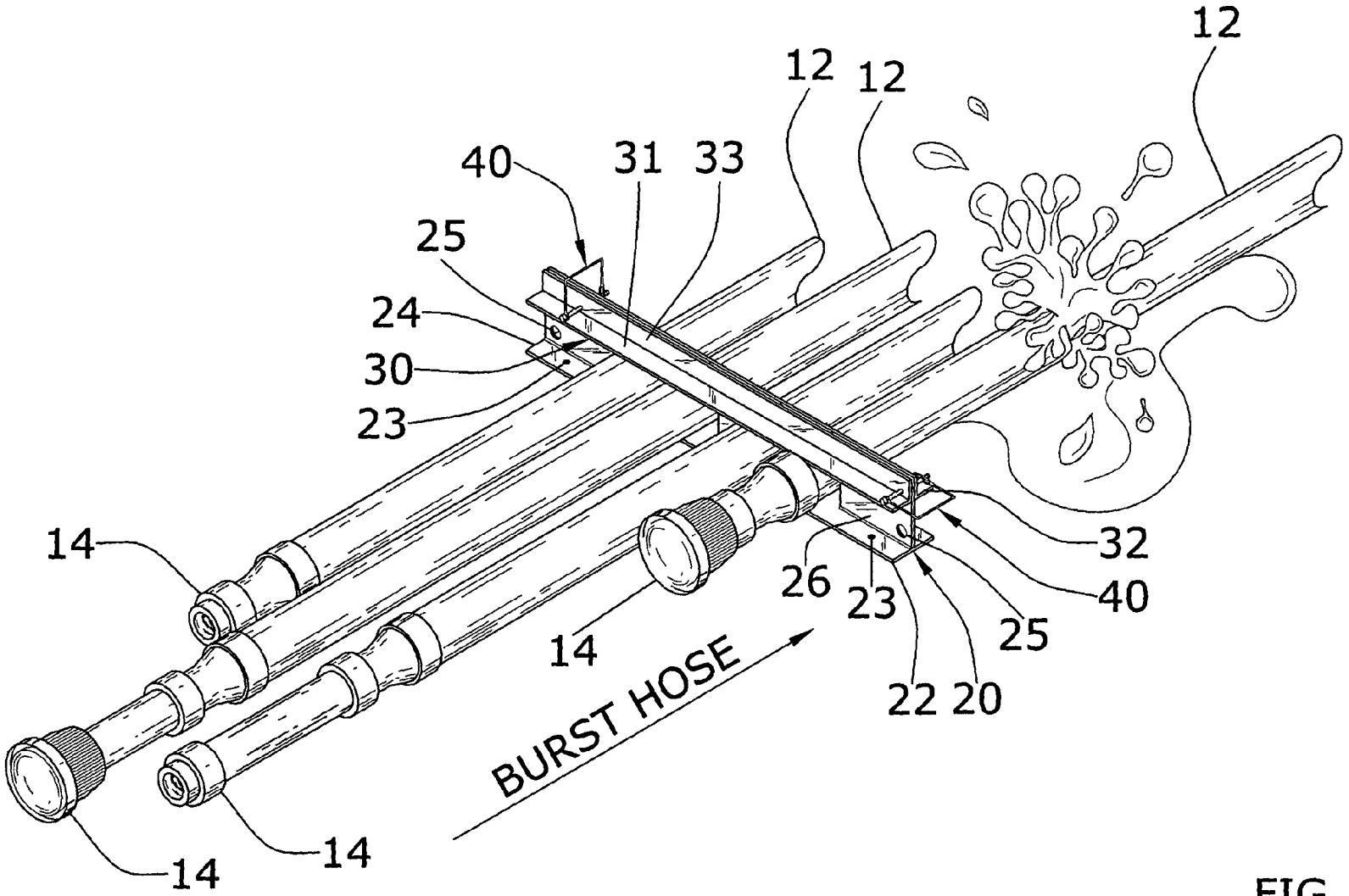
FIG. 7 is an upper perspective view of the present invention showing a burst hose.

As best shown in FIGS. 2 and 5, once the appropriate mounting aperture 29 is determined, a first retaining pin 40 is extended through the first aperture 36 in the first retaining bracket 30 located on one side of the first mounting plate 26, through the pre-determined mounting aperture 29 in the first mounting plate 26 and through the first aperture 36 in the second retaining bracket 32 located on the other side of the first mounting plate 26. As best shown in FIGS. 6 and 7, the retaining brackets 30, 32 are pivoted about the retaining pin 40 such that the base 31 of each retaining bracket 30, 32 lies tangent to the hoses 12 being retained and parallel to the base plate 31. A second retaining pin 40 is then extended through the second aperture 38 in the first retaining bracket 30 located on one side of the second mounting plate 28, through the pre-determined mounting aperture 29 in the second mounting plate 28 and through the second aperture 38 in the second retaining bracket 32 located on the other side of the second mounting plate 28. As shown in FIGS. 1 through 7, the spacer plates 34 preferably attached to the second retaining bracket 32 to provide additional support between the retaining brackets 30, 32.

As shown in FIG. 6, during the water pressure testing of the hoses 12, the coupling 14 ends extend away from the base member 20 and the fire hose safety anchor and securement system 10. The fire hose safety anchor and securement system 10 secures the hoses 12 during the pressure test, such that the hose 12 ends are not able to move around uncontrollably and possibly injure someone. Furthermore, as shown in FIG. 7, if a hose were to burst during the water pressure test, the coupling 14 on that hose 12 would only recoil back to the point at which the coupling 14 comes in contact with the first retaining bracket 30 and the base plate 31. As a result of the fire hose safety anchor and securement system 10, a recoiling hose 12 is stopped from potentially injuring someone or damaging any objects.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A hose anchor and securement system comprising:

(A) a base plate;

(B) a first mounting plate and a second mounting plate each extending perpendicularly outward from a flat surface of the base plate, the first and second mounting plates each having a plurality of mounting apertures;

(C) a first and second retaining bracket, the first and second retaining brackets each having at least one retaining bracket aperture, the first and second retaining brackets retained to the first mounting plate by a first retaining pin, the first retaining pin extending through the retaining bracket apertures and one of the mounting apertures, the first and second retaining brackets adapted to pivot about the first retaining pin while a hose is received in the hose anchor and securement system; and (D) a center plate mounted to the base plate, the center plate located between the first and second retaining brackets.

2. The hose anchor and securement system of claim 1, wherein the first and second retaining brackets are further retained to the second mounting plate by a second retaining pin.

3. The hose anchor and securement system of claim 1, wherein the first and second mounting plates are located between the first and second retaining brackets.

4. The hose anchor and securement system of claim 1, wherein the base plate has a first anchor aperture and the mounting plate has a second anchor aperture.

5. The hose anchor and securement system of claim 1, wherein the plurality of mounting apertures allows for the accommodation of different diameter hoses.

6. A hose anchor device comprising:

(A) a base plate having at least one first anchor aperture;

(B) a first mounting plate coupled to the base plate, the first mounting plate having a first mounting aperture and a second anchor aperture;

(C) a second mounting plate coupled to the base plate, the second mounting plate having a second mounting aperture and a third anchor aperture, the anchor apertures being adapted to secure the hose anchor device;

(D) a first retaining bracket pivotally coupled to either the first or the second mounting plate;

(E) a second retaining bracket pivotally coupled to the first mounting plate;

(F) a retaining pin removably coupling the first and second retaining brackets to the second mounting plate;

(G) wherein the base plate, the first and second mounting plates and at least one of the first and second retaining brackets together define at least one opening for receiving at least one hose in the hose anchor device; and (H) wherein a center plate is mounted to the base plate, the center plate located between the first and second retaining brackets and between the first and second mounting plates.

7. The hose anchor device of claim 6, wherein the first and second mounting plates each have a plurality of mounting apertures, the plurality of mounting apertures allowing for the accommodation of different diameter hoses.

8. The hose anchor device of claim 6, wherein the first and second retaining brackets each have at least one aperture.

9. The hose anchor and securement system of claim 1, wherein the base plate, the first and second mounting plates and at least one of the first and second retaining brackets together define at least one opening for receiving at least one hose.

10. The hose anchor device according to claim 6, wherein the first mounting plate and the second mounting plate each extend substantially perpendicular from a flat surface of the base plate.

* * * * *